US009114633B2

(12) United States Patent
Kuronuma et al.

(10) Patent No.: US 9,114,633 B2
(45) Date of Patent: Aug. 25, 2015

(54) PRINTING APPARATUS WITH AN ADHESIVE APPLYING FUNCTION

(71) Applicant: CASIO COMPUTER CO., LTD., Shibuya-ku, Tokyo (JP)

(72) Inventors: Hirotaka Kuronuma, Akishima (JP); Akio Tsuji, Hamura (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/274,048

(22) Filed: May 9, 2014

(65) Prior Publication Data

US 2014/0340462 A1 Nov. 20, 2014

(30) Foreign Application Priority Data

May 16, 2013 (JP) ..... 2013-103595
May 16, 2013 (JP) ..... 2013-103599

(51) Int. Cl.
*B41J 3/407* (2006.01)

(52) U.S. Cl.
CPC ..... *B41J 3/4075* (2013.01)

(58) Field of Classification Search
CPC ..... B41J 3/4075; B41J 11/66
USPC ..... 347/212; 156/364, 277, 384, 387; 400/621
See application file for complete search history.

(56) References Cited

U.S. PATENT DOCUMENTS 5,450,541 A * 9/1995 Rourke et al. ..... 715/247
2007/0215288 A1* 9/2007 Weber et al. ..... 156/384
2011/0277905 A1 11/2011 Koike
2013/0292061 A1* 11/2013 Tanaka ..... 156/538
2014/0056632 A1* 2/2014 Murai et al. ..... 400/621

FOREIGN PATENT DOCUMENTS

JP 2011-235595 A 11/2011
JP 2012-025165 A 2/2012

* cited by examiner

*Primary Examiner* — Sarah Al Hashimi
(74) *Attorney, Agent, or Firm* — Holtz, Holtz, Goodman & Chick PC

(57) ABSTRACT

A printing apparatus having an adhesive applying function is provided with a transporting mechanism for transporting an elongated print member, a transferring mechanism for transporting a transferring member having adhesive, contained in a cartridge installed on the apparatus, and for selectively bringing the transferring member into contact with the print member transported by the transporting mechanism, thereby transferring the adhesive of the transferring member onto the surface of the print member which no data is to be printed on, a controlling unit for controlling whether the transferring mechanism transfers the adhesive of the transferring member onto the surface of the print member which no data is to be printed on, and a printing mechanism provided on the downstream side of the transferring mechanism, for processing print data including rotation of the data in unit of 90 degrees, and for printing the data on the surface of the print member.

18 Claims, 7 Drawing Sheets

PRINTING APPARATUS WITH AN ADHESIVE APPLYING FUNCTION

CROSS-REFERENCE TO RELATED APPLICATION

The present application is based upon and claims the benefit of priority from the prior Japanese Patent Application No. 2013-103595 and No. 2013-103599, both filed May 16, 2013, the entire contents of which are incorporated herein by reference.

BACKGROUND OF THE INVENTION

1. Field of the Invention

The present invention relates to a printing apparatus with an adhesive applying function, and more particularly, to a printing apparatus with an adhesive applying function which can designate without any restriction adhesive transferring areas (overall area, left extreme area, right extreme area, top area, and bottom area) on a label to be produced, where adhesive is to be transferred.

2. Description of the Related Art

In the past, printed matters such as print media with a front surface printed with data and a rear surface applied with adhesive were known. Usually, a rolled type of media are known as these print media. There are two types of rolled print media: one with a detaching paper attached on the adhesive applied surface; and the other with no such detaching paper. In either type of rolled print media, the adhesive is applied overall on the rear surface of the print medium.

Meanwhile, a printing apparatus has been proposed in Japanese Unexamined Patent Publication No. 2011-235595, which apparatus is provided with an external adhesive transferring device on the downstream side of its print-paper discharge opening. This adhesive transferring device allows the printing apparatus to use low-cost standard paper in place of expensive specialized paper. In the printing apparatus, printed recording paper is cut by a cutter and then applied with the adhesive. During the process of applying the adhesive onto the recording paper, an adhesive tape is pressed against or alternatively, released from the recording paper.

The printing apparatus allows the user to decide whether to transport the recording paper while the adhesive tape is pressed against the recording paper or to pull out the cut recording paper with his/her hand while the adhesive tape is released from the recording paper. When the user decides to pull out the recording paper with his/her hand, the adhesive transferring device transfers the adhesive onto a printed portion of the recording paper when said printer portion passes through the device.

But, the printing apparatus disclosed in Japanese Unexamined Patent Publication No. 2011-235595 simply proposes that the apparatus can use the low-cost standard paper in place of the expensive specialized paper, and is nothing different from conventional apparatuses in providing the recording paper with the overall rear-surface applied with the adhesive. Further, the printing apparatus is provided with the external adhesive transferring device, and therefore the apparatus cannot be made compact in size.

The users want various types of paper, paper with the adhesive applied or paper with no adhesive applied, depending on purpose of usage of the print paper. Even if the print paper with the adhesive applied is required, the users can want the print paper with the adhesive applied overall or partially thereon. To meet the users' requirement, Japanese Unexamined Patent Publication No. 2012-25165 has proposed a tape printing apparatus which is provided with an auxiliary cassette for applying gum onto the tape. The auxiliary cassette is installed in the vicinity of its tape discharge opening to apply gum onto the user's desired position on the print tape.

The tape printing apparatus disclosed by Japanese Unexamined Patent Publication No. 2012-25165 performs the process of applying the adhesive onto the print tape, in the vicinity of its tape discharge opening in a similar manner to the printing apparatus proposed by Japanese Unexamined Patent Publication No. 2011-235595, in other words, the adhesive transferring mechanism is provided on the downstream side of the printing mechanism and/or the tape discharge opening. In these apparatuses, the adhesive transferring operation is performed independently of it printing operation, that is, the printing operation is not controlled in connection with the adhesive transferring operation.

SUMMARY OF THE INVENTION

The present invention has been made in consideration of the inconveniences involved in the conventional apparatuses, and provides a printing apparatus with an adhesive applying function which has an adhesive transferring mechanism on the upper-stream side of a printing mechanism and can designate without any restriction an adhesive transferring area (overall area, left extreme area, right extreme area, top area, and, bottom area) on a label to be produced.

According to one aspect of the invention, there is provided a printing apparatus with an adhesive applying function which comprises an apparatus body which detachably receives a cartridge containing a transferring member having adhesive, a transporting mechanism which transports an elongated print member, one surface of which data is to be printed on and the other surface of which no data is to be printed on, a transferring mechanism which transports the transferring member having adhesive, contained in the cartridge, when the cartridge is installed on the apparatus body, and which selectively brings the transferring member into contact with the print member transported by the transporting mechanism while transporting the transferring member, thereby transferring the adhesive of the transferring member onto the surface of the print member, which surface no data is to be printed on, a transfer controlling unit which controls whether or not the transferring mechanism transfers the adhesive of the transferring member onto the surface of the print member, which surface no data is to be printed on, and a printing mechanism which is provided in a transport direction of the print member transported by the transporting mechanism and on a downstream side of the transferring mechanism, and which prints data on the surface of the print member, which surface data is to be printed on.

In the above printing apparatus with an adhesive applying function, the printing mechanism enlarges or reduces in size print data and rotates the print data by a user's desired angles in unit of 90 degrees, and then prints the print data on the surface of the print member, which surface data is to be printed on.

According to another aspect of the invention, there is provided a printing apparatus with an adhesive applying function which comprises an apparatus body which detachably receives a cartridge containing a transferring member having adhesive, a transporting mechanism which transports an elongated print member, one surface of which data is to be printed on and the other surface of which no data is to be printed on, a transferring mechanism which transports the transferring member having adhesive, contained in the cartridge, when the cartridge is installed on the apparatus body, and which selectively brings the transferring member into contact with the print member transported by the transporting mechanism while transporting the transferring member, thereby transferring the adhesive of the transferring member onto the surface of the print member, which surface no data is to be printed on, a transfer controlling unit which controls whether or not the transferring mechanism transfers the adhesive of the transferring member onto the surface of the print member, which surface no data is to be printed on, and a printing mechanism which enlarges or reduces in size print data and rotates the print data by a user's desired angles in unit of 90 degrees, and then prints the print data on the surface of the print member, which surface data is to be printed on.

In the above printing apparatus with an adhesive applying function, the printing mechanism is provided in a transport direction of the print member transported by the transporting mechanism and on a downstream side of the transferring mechanism.

The above printing apparatus with an adhesive applying function, further comprises a cutting unit for cutting the print member, which is provided in a transport direction of the print member transported by the transporting mechanism and on a downstream side of the printing mechanism.

In the above printing apparatus with an adhesive applying function, the transporting mechanism comprises the printing mechanism and the transferring mechanism, and the printing mechanism comprises a platen roller and a thermal head, and the platen roller serves as one of transport rollers of the transporting mechanism.

In the above printing apparatus with an adhesive applying function, the transferring mechanism comprises a pair of transferring rollers, which are brought into close to each other so as to sandwich the print member and the transferring member between said two rollers, thereby transporting the two members, wherein the pair of transferring rollers consists of a pressing/transferring roller of the apparatus body and a transferring roller of the cartridge.

In the above printing apparatus with an adhesive applying function, the transferring member is made of an elongated mat whose one surface is applied all over with adhesive, and is wound around a feed roller, fed to a take-up roller with a no adhesive-applied surface of the transferring member in contact with one of the pair of transferring rollers, and the one of the transferring rollers, the feed roller and the take-up roller are contained in the cartridge.

For use with the printing apparatus with an adhesive applying function, plural cartridges are prepared, each containing different adhesive of a different adhesive force, respectively. The print member is a heat-sensitive tape.

In the above printing apparatus with an adhesive applying function of the present invention, the adhesive transferring mechanism is provided on the upper-stream side of the printing mechanism. Since the printing mechanism enlarges or reduces in size print data and rotates the print data by a user's desired angles in unit of 90 degrees, and then prints the print data on the label, the adhesive transferring mechanism can select without any restriction the adhesive transferring area (overall area, left extreme area, right extreme area, top area, and, bottom area) on the label to be produced. Further, the apparatus can be produced compact in size and in a low cost.

BRIEF DESCRIPTION OF THE DRAWINGS

A more complete understanding of the present invention will be obtained when the following detailed description is read in conjunction with the following drawings, in which.

DETAILED DESCRIPTION OF THE PREFERRED EMBODIMENTS

Figure 3:
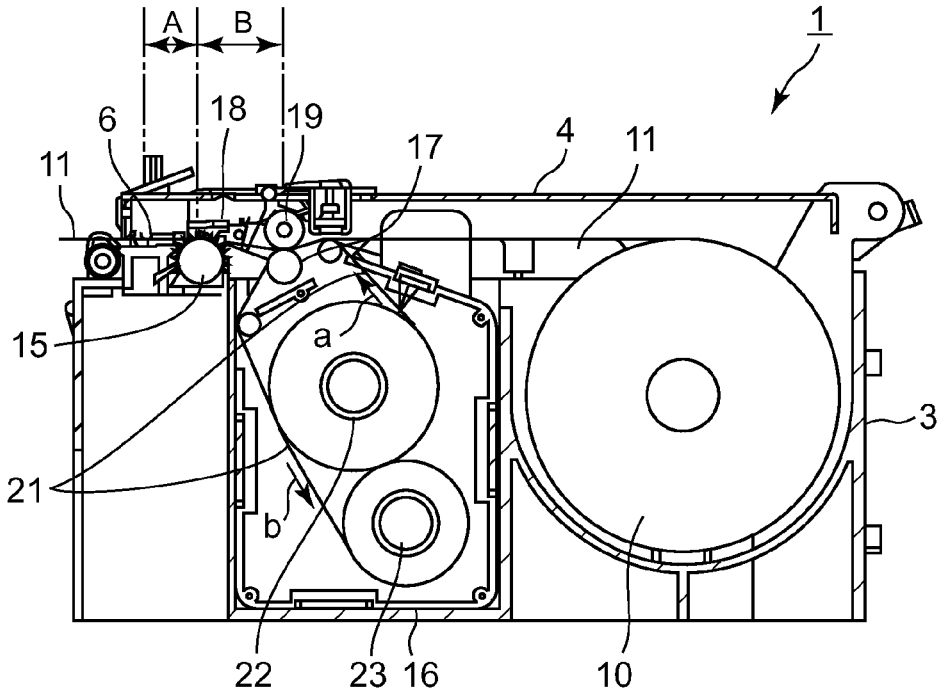
FIG. 3 is a cross-sectional view illustrating the printing apparatus with an adhesive applying function and a cartridge installed between a platen roller and a print roll member.

Now, the preferred embodiments of the present invention will be described with reference to the accompanying drawings in details. FIG. 3 is a cross-sectional view illustrating a printing apparatus with an adhesive applying function according to the embodiment of the invention. In the printing apparatus according to the embodiment of the invention, a transport mechanism mainly consists of a platen roller 15 and a thermal head 18, and also a printing mechanism mainly consists of the platen roller 15 and the thermal head 18. A transferring member, for example, consists of an adhesive tape 21. A transferring mechanism mainly consists of the adhesive tape 21, a transferring roller 17 and a pressing/transferring roller 19. A transfer controlling unit comprises a controlling apparatus. A cutting unit comprises a tape cutter 6. In the description hereinafter, an expression of "printing characters" and an expression of "printing operation" are used for the same meaning.

Figure 1A:
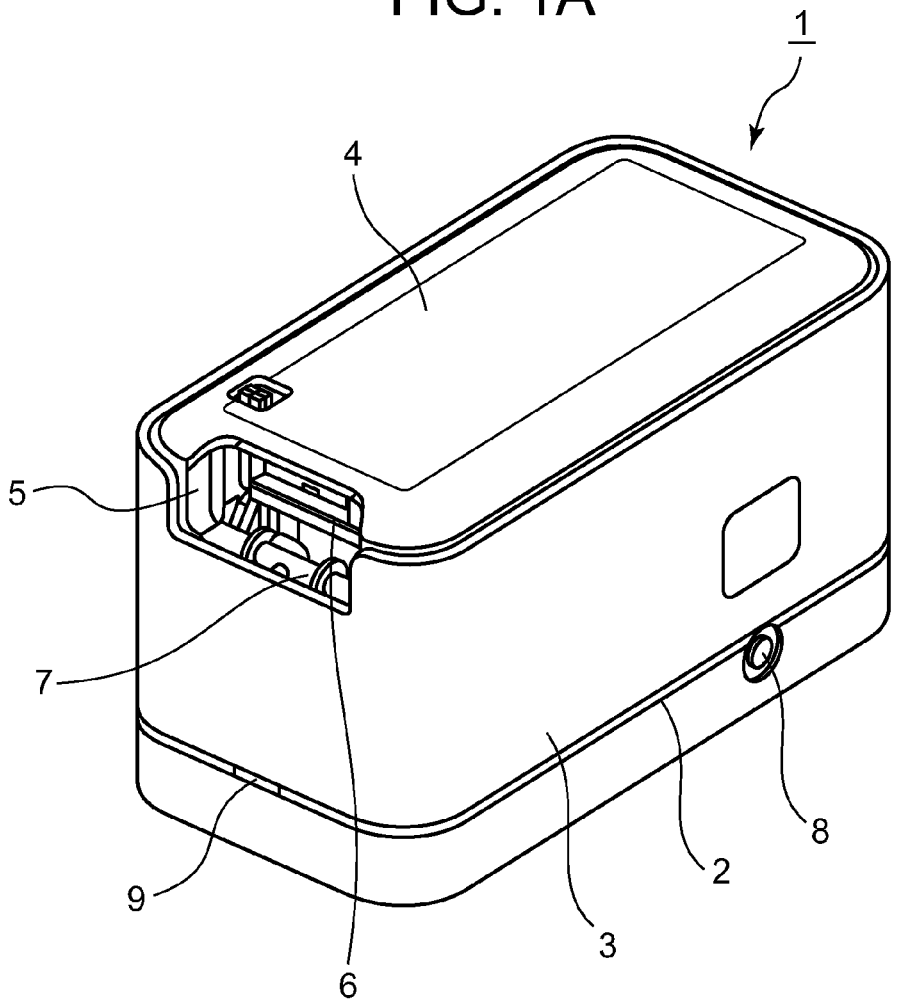
FIG. 1A is an external perspective view of the printing apparatus with an adhesive applying function according to the embodiment of the invention.

FIG. 1A is an external perspective view of the printing apparatus with an adhesive applying function according to the embodiment of the invention.

Figure 1B:
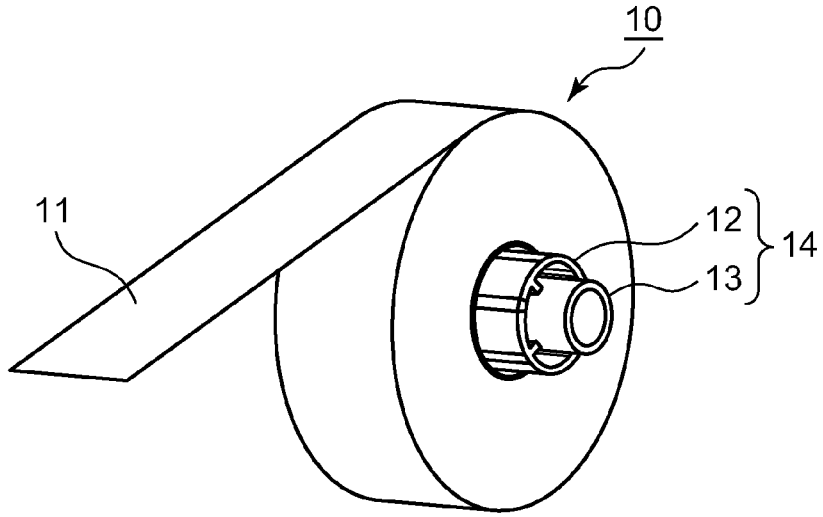
FIG. 1B is a view showing a heat-sensitive roll paper to be installed on the printing apparatus with an adhesive applying function.

FIG. 1B is a view showing a heat-sensitive roll paper to be installed on the printing apparatus with an adhesive applying function.

As illustrated in FIG. 1A, the printing apparatus 1 with an adhesive applying function is substantially of a cuboid. The printing apparatus 1 has an apparatus body 3 with a decoration groove 2 provided in its external surface on the lower side, and a hinged cover 4 provided on an opening portion of the body 3.

As shown in FIG. 1A, the upper front portion of the apparatus body 3 and the front portion of the hinged cover 4 are cut out to form an outlet chute 5 for discharging a printed tape. In the vicinity of the outlet chute 5, there are provided the tape cutter 6 for cutting the printed tape and an exhausting roller 7 on a downstream side for exhausting the cut tape from the outlet chute 5.

On the side surface of the apparatus body 3, there is provided a plug 8 on the lower side of the decoration groove 2. The plug 8 is for receiving a power plug. Further, on the front surface of the apparatus body 3, there is provided an USB (Universal Serial Bus) terminal 9 in the decoration groove to be connected with an USB terminal of a host apparatus.

The elongated print member 10 illustrated in FIG. 1B comprises the heat-sensitive roll paper 11 and a roll supporting unit 14. The roll supporting unit 14 consists of an axle 13 and a reel 12 which is supported by the axle 13 and free to rotate about the axle 13. The heat-sensitive roll paper (hereinafter, simply referred to as the "tape paper") 11 is cut into an elongated tape form and wound around the reel 12.

Figure 2:
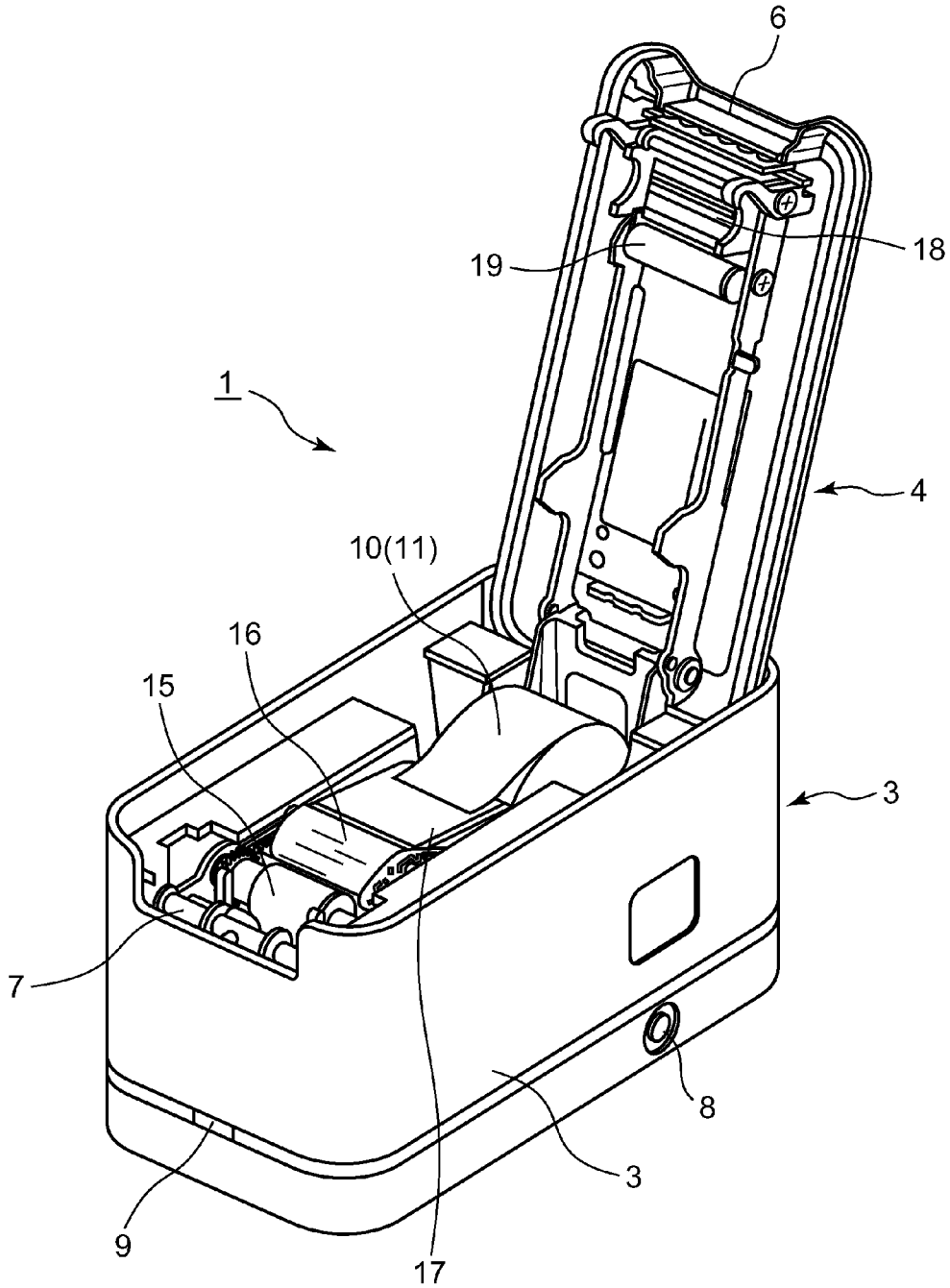
FIG. 2 is a perspective view illustrating the printing apparatus having the adhesive applying function with a hinged cover open.

FIG. 2 is a perspective view illustrating the printing apparatus 1 having the adhesive applying function with the hinged cover 4 open. In FIG. 2, the same units and/or parts as those in FIG. 1A and FIG. 1B are designated by the same reference numerals.

As illustrated in FIG. 2, within the apparatus body 3 of the printing apparatus 1 with the adhesive applying function, there are provided the platen roller 15 in addition to the exhausting roller 7 and the roll print member 10 or the roll tape paper 11 illustrated in FIG. 1A and FIG. 1B. Further, a cartridge 16 having the built-in transferring member is installed between the platen roller 15 and the print member 10. The transferring roller 17 of the cartridge 16 can be seen slightly in FIG. 2. The cartridge 16 will be described in detail later.

Further, as illustrated in FIG. 2, there are provided the thermal head 18 and the pressing/transferring roller 19 on the rear surface of the hinged cover 4 of the printing apparatus 1 with the adhesive applying function, in addition to the tape cutter 6 illustrated in FIG. 1A and FIG. 1B. The pressing/transferring roller 19 cooperates with the transferring roller 17 of the cartridge 16 to apply the adhesive onto the tape paper 11.

FIG. 3 is the cross-sectional view of the printing apparatus 1 with the adhesive applying function. In FIG. 3, an internal structure of the cartridge 16 is illustrated, which is detachably installed between the platen roller 15 and the print member 10. In FIG. 3, the same units and/or parts as those in FIG. 1A, FIG. 1B and FIG. 2 are designated by the same reference numerals.

In FIG. 3, the thermal head 18 has a printing portion consisting of an array of heater-elements at its front end, and is supported on a support shaft and free to rotate about the support shaft. During a printing operation, the thermal head 18 is pressed against the platen roller 15 via the tape paper 11 as shown in FIG. 3, whereby the printing is performed on tape paper 11. During no printing operation, the thermal head 18 is brought and kept away from the platen roller 15.

In the printing operation, the platen roller 15 also serves as one of transport rollers. As seen in FIG. 3, the cartridge 16 is installed beneath the tape paper 11 extended from the print member 10 toward the platen roller 15 and between the print member 10 and the platen roller 15.

The cartridge 16 contains the adhesive tape 21 as the transferring member, a feed roller 22 for feeding the adhesive tape 21, and a take-up roller 23 for taking up the adhesive tape 21, as shown in FIG. 3. The adhesive tape 21 consists of a tape mat with adhesive applied over its one-side surface.

Inside the hinged cover 4 of the printing apparatus 1 with the adhesive applying function, there is provided the pressing/transferring roller 19 at the position facing the transferring roller 17 of the cartridge 16 installed in position. The pressing/transferring roller 19 of the cover 4 and the transferring roller 17 of the cartridge 16 compose a transferring unit of an adhesive transferring mechanism.

The adhesive tape 21 wound around the feed roller 22 is fed to the take-up roller 23 to be rolled on with the no adhesive applied surface of the adhesive tape 21 in contact with the transferring roller 17.

The pressing/transferring roller 19 provided on the hinged cover 4 is brought toward or away from the transferring roller 17 of the cartridge 16 by means of a gear train (not shown) with the tape paper 11 and the adhesive tape 21 kept sandwiched there between.

When the pressing/transferring roller 19 of the hinged cover 4 has been brought toward the transferring roller 17 of the cartridge 16, the pressing/transferring roller 19 and the transferring roller 17 cooperate together to sandwich the tape paper 11 and the adhesive tape 21 between them, whereby the adhesive starts transferring from the adhesive tape 21 onto the rear surface (not printing surface) of the tape paper 11.

At this time, the adhesive tape 21 is fed from the feed roller 22 in the direction indicated by an arrow "a" to meet with the tape paper 11, whereby both the adhesive tape 21 and the tape paper 11 are sandwiched between the pressure roller 21 and the transferring roller 17 and the adhesive of the adhesive tape 21 is transferred onto the rear surface of the tape paper 11.

The used adhesive tape 21 or the tape 21 whose adhesive has been transferred onto the tape paper 11 is further transported in the direction indicated by an arrow "b" to be taken up by the take-up roller 23. Hereinafter, when the pressing/transferring roller 19 is brought toward the transferring roller 17, sometimes it will be expressed that "the pressing/transferring roller 19 is kept down", and when the pressing/transferring roller 19 is brought away from the transferring roller 17, sometimes it will be expressed that "the pressing/transferring roller 19 is kept up".

Figure 4:
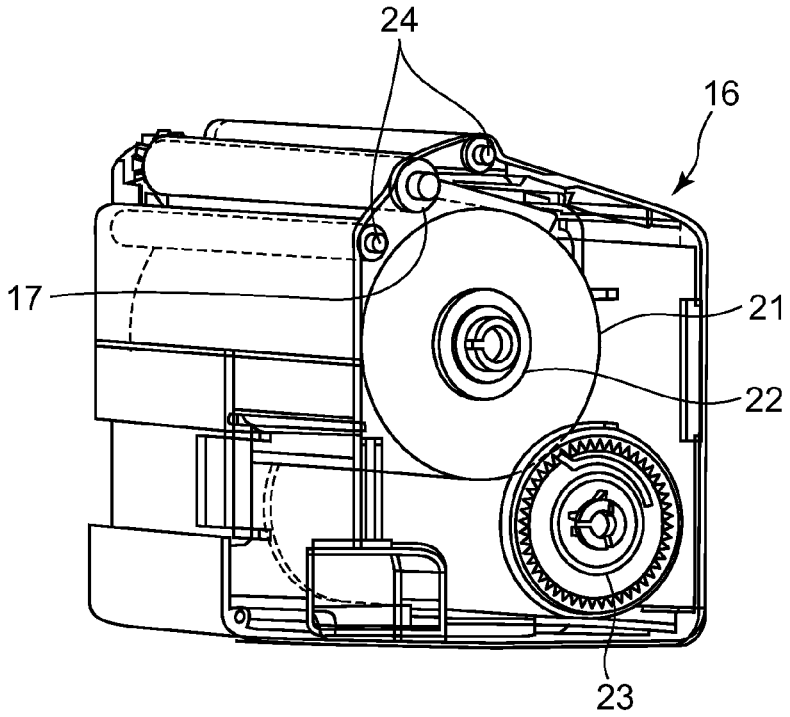
FIG. 4 is a perspective view illustrating the cartridge detached from the apparatus body of the printing apparatus with an adhesive applying function.

FIG. 4 is a perspective view illustrating the cartridge 16 detached from the apparatus body 4 of the printing apparatus 1. In FIG. 4, the same units and/or parts as those in FIG. 3 are designated by the same reference numerals as those in FIG. 3. As shown in FIG. 4, there are provided two guide rollers 24, 24 for guiding the adhesive tape, respectively on the upstream and downstream sides of the transferring roller 17. The plural pieces of cartridges 21 are prepared, corresponding respectively to different kinds of adhesive tapes.

Figure 5:
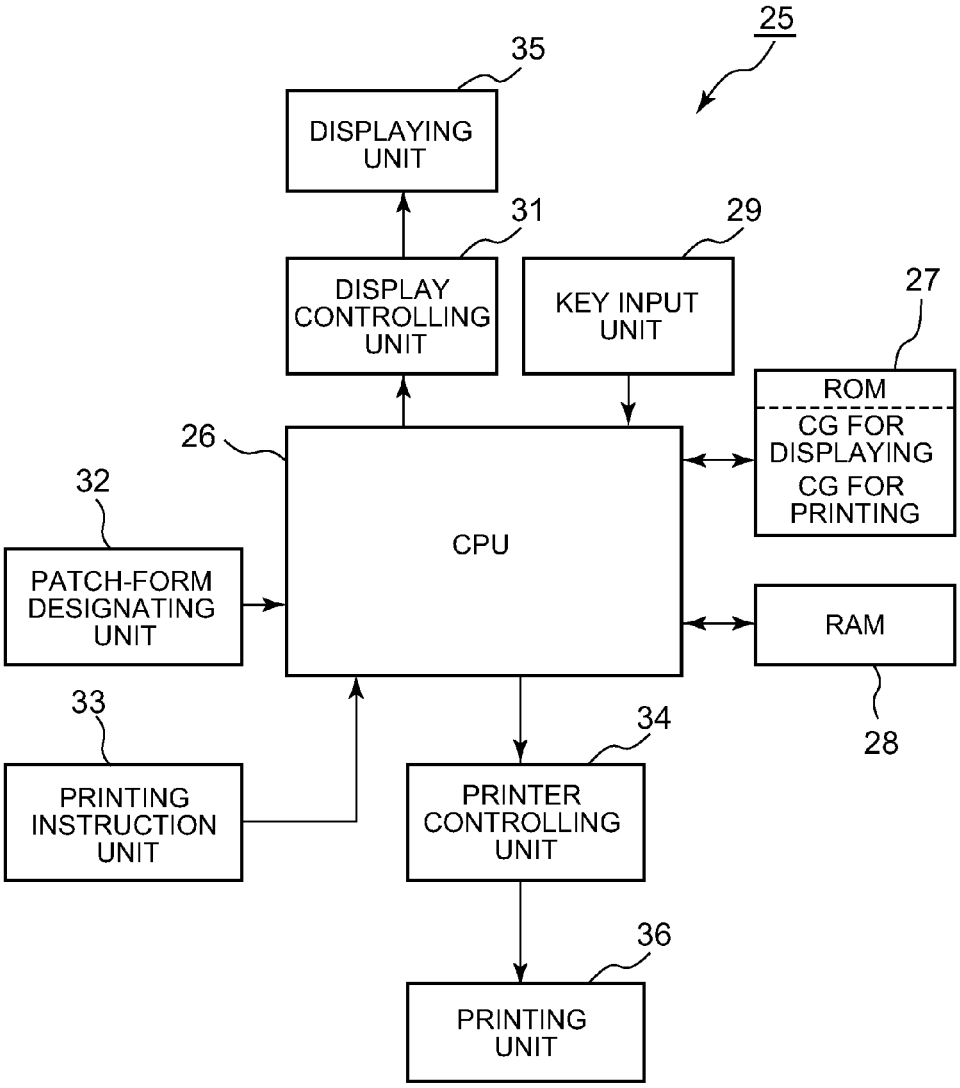
FIG. 5 is a block diagram showing a circuit configuration of the printing apparatus with an adhesive applying function according to the embodiment of the invention.

FIG. 5 is a block diagram showing a circuit configuration (including a controlling apparatus) of the printing apparatus 1 with the adhesive applying function according to the embodiment of the invention. As shown in FIG. 5, the controlling apparatus 25 of the printing apparatus 1 comprises CPU (Central Processing Unit) 26, ROM (Read Only Memory) 27, RAM (Random Access Memory) 28, a key input unit 29, a display controlling unit 31, a patch-form designating unit 32, a printing instruction unit 33, a printer controlling unit 34, a displaying unit 35, and a printing unit 36. These elements and units are connected to CPU 26.

ROM 27 stores a program for CPU 26 to control operations of various units in the controlling apparatus, and a table containing data of characters, symbols and pictograms and various sorts of size information. RAM 28 temporarily stores data used by CPU 26 for performing various operations, data to be displayed on the displaying unit 35, and data to be supplied to the printer controlling unit 34.

CPU 26 performs various operating processes in accordance with the control program stored in ROM 27, thereby controlling operations of the various units in the controlling apparatus. The key input unit 29 is a data-input port connected to the USB terminal 9 of the apparatus body 3. Print data (data and/or characters to be printed) is entered from the external host apparatus through the key input unit 29 to RAM 28 to be temporarily stored therein.

CPU 29 reads the print data from RAM 28 and edits (rotates, enlarges, and/or reduces in size) the read data in accordance with a patch form designated and supplied from the patch-form designating unit 32, and then stores the edited print data in RAM 28, again.

The display controlling unit 31 has the displaying unit 35 consisting of LCD (Liquid Crystal Displaying Device). The displaying unit 35 displays the entered characters, edited print data, and a selecting mark for selecting a symbol and pictogram, under control of the display controlling unit 31.

The patch-form designating unit 32 designates either one of the following five patch forms, that is, transferring forms of the adhesive: an overall area; left extreme area; right extreme area; top area; and, bottom area. The printing instruction unit 33 gives the printer controlling unit 34 an instruction of starting a printing operation and/or an instruction of ceasing the printing operation. The printer controlling unit 34 is connected with the printing unit 36 consisting of the thermal head 18 and the platen roller 15.

The printer controlling unit 34 controls movement of the pressing/transferring roller 19 toward the transferring roller 17 in accordance with the transferring form of the adhesive designated by the patch-form designating unit 32, and also supplies the printing unit 36 with print data stored in a printing buffer area of RAM 28.

FIGS. 6A, 6B, 6C, 6D and 6E are views illustrating labels 37 (37*a*, 37*b*, 37*c*, 37*d* and 37*e*) produced from the tape paper 11, in accordance with the transferring forms of the adhesive: an overall area; left extreme area; right extreme area; top area; and, bottom area, designated by the patch-form designating unit 32, respectively. FIGS. 6A, 6B, 6C, 6D and 6E are views illustrating characters printed on the front surfaces of the labels 37*a*, 37*b*, 37*c*, 37*d* and 37*e*, and also the adhesive applied on the rear surfaces of these labels.

To make it clear, the adhesives 38 transferred respectively onto the rear surfaces of the labels 37*a*, 37*b*, 37*c*, 37*d* and 37*e* are seen through their front surfaces in FIGS. 6A, 6B, 6C, 6D and 6E. The transferred adhesives are indicated by hatched portions in the drawings. When the tape paper 11 is transported in the direction indicated by an arrow "c" (FIG. 6A), the adhesive 38 is transferred onto given areas defined by "f" on the surfaces of the labels 37*b* (the left extreme area is designated), 37*c* (the right extreme area is designated), 37*d* (the top area is designated), and 37*e* (the bottom area is designated) except the label 37*a* (the overall area is designated).

Figure 6A:
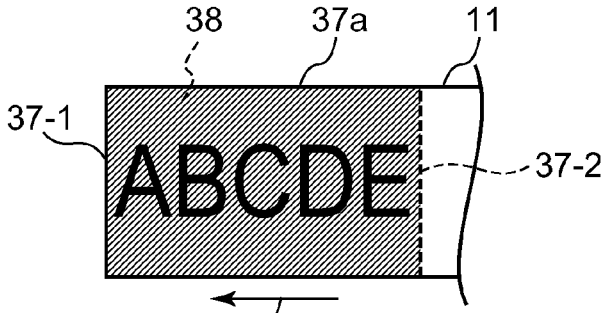
FIGS. 6A, 6B, 6C, 6D and 6E are views illustrating character strings printed on labels produced from tape paper, and also adhesives transferred on the labels in accordance with designated adhesive transferring forms, respectively.
Figure 6B:
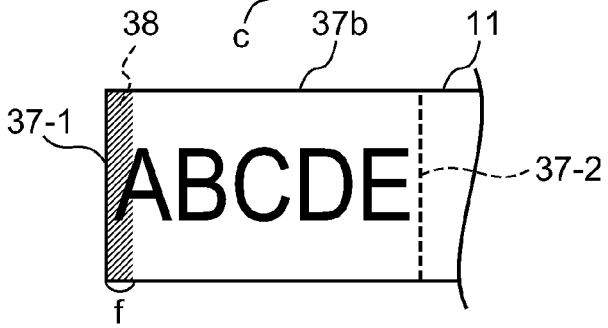
Figure 6C:
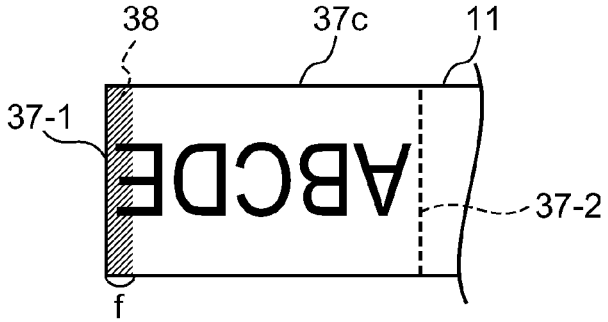
Figure 6D:
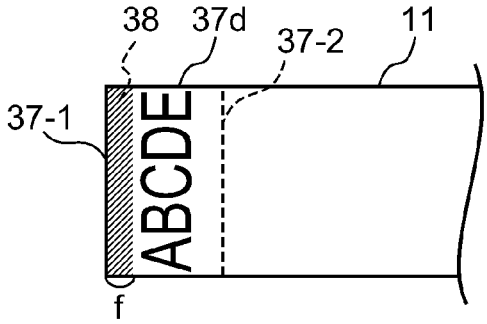
Figure 6E:
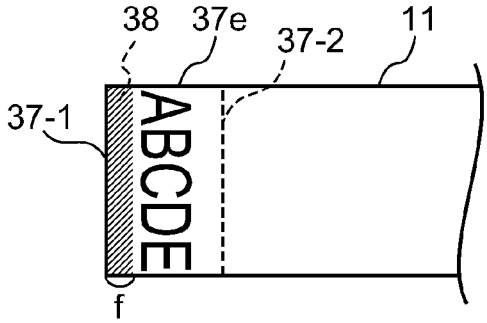

FIG. 6A illustrates the label 37*a*, onto which the adhesive has been transferred when the overall area is designated. FIG. 6B illustrates the label 37*b*, onto which the adhesive has been transferred when the left extreme area is designated. FIG. 6C illustrates the label 37*c*, onto which the adhesive has been transferred when the right extreme area is designated. FIG. 6D illustrates the label 37*d*, onto which the adhesive has been transferred when the top area is designated. FIG. 6E illustrates the label 37*e*, onto which the adhesive has been transferred when the bottom area is designated.

In FIGS. 6A, 6B, 6C, 6D and 6E, the labels 37 are illustrated with a portion indicated by 37-1 cut out and a portion indicated by 37-2 not cut out. Hereinafter, a printing process and an adhesive transferring process will be described, which are to be performed by CPU 26 of the controlling apparatus 25, when the overall area, the left extreme area, the right extreme area, the top area, and the bottom area are designated by the patch-form designating unit 32.

Figure 7:
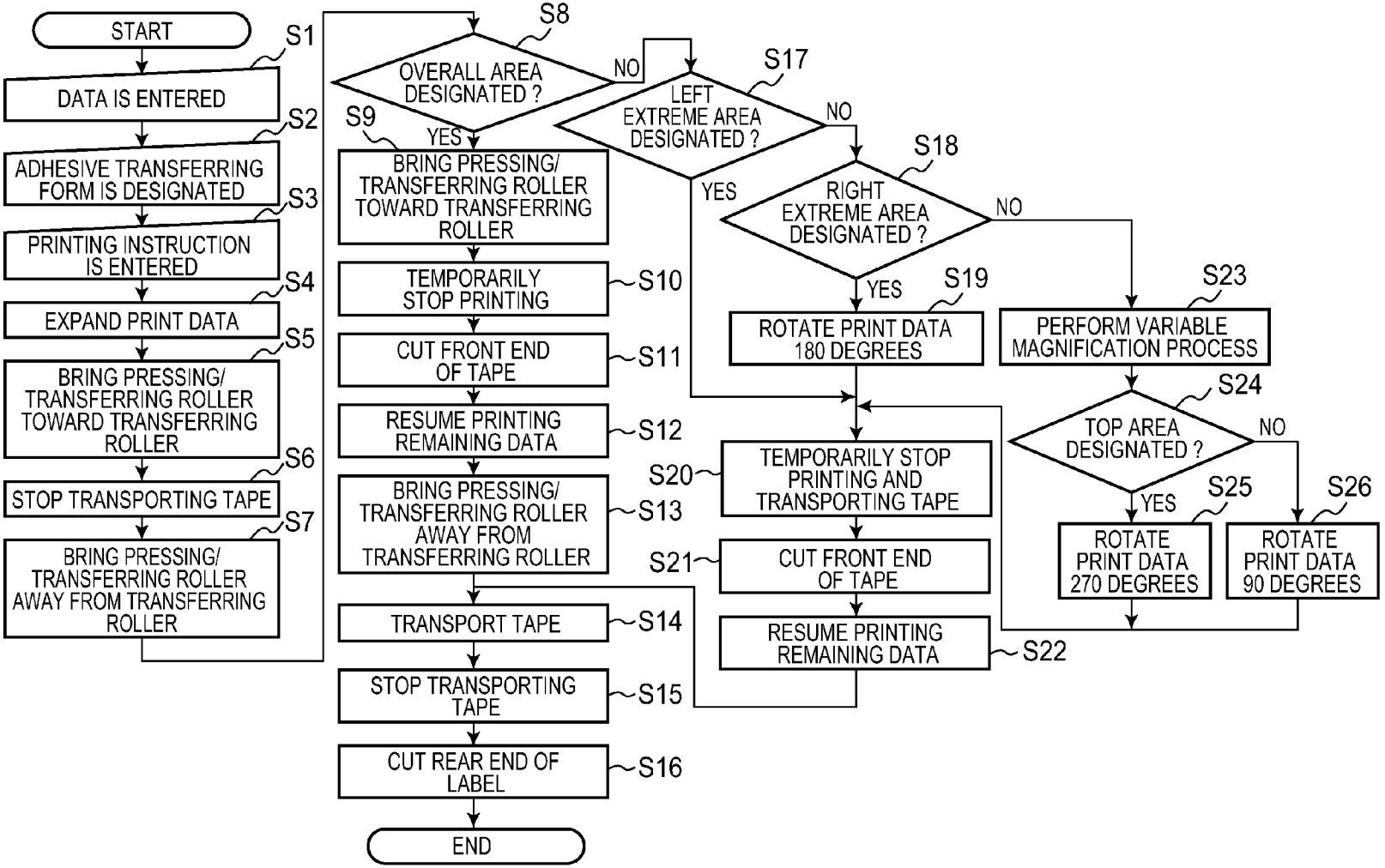
FIG. 7 is a flow chart of a printing process and a adhesive transferring process which are performed when a label is produced in the present printing apparatus with an adhesive applying function according to the embodiment of the invention.

FIG. 7 is a flow chart of the printing process and the adhesive transferring process which are performed when a label is produced in the printing apparatus 1 with the adhesive applying function according. When the process starts, data is entered (step S1).

In the process, a user operates the key input unit 29 to enter print data including character data (for example, a character string "ABCDE") and decoration data (for example, bold characters) for printing. The entered print data is displayed on displayed on the displaying unit 35 for confirmation by the user.

The adhesive transferring form (the overall area; left extreme area; right extreme area; top area; or bottom area) is designated (step S2). In the process, the patch-form designating unit 32 displays a selection/input image (similar to those illustrated in FIGS. 6A, 6B, 6C, 6D and 6E) on the displaying unit 35, allowing the user to select his/her desired adhesive transferring form. Then, the user can select his/her desired adhesive transferring form on the displaying unit 35, that is, selects one of the overall area, left extreme area, right extreme area, top area, and bottom area as the adhesive transferring form.

When the print data has been entered and the adhesive transferring form has been selected, CPU 26 of the controlling apparatus 25 receives the user's instruction of printing operation through the printing instruction unit 33 (step S3). Upon receipt of the printing instruction, CPU 26 expands the print data entered at step S1 on a predetermined bit map area of RAM 28 (step S4).

Further, CPU 26 brings the pressing/transferring roller 19 toward the transferring roller 17 (step S5) to sandwich the adhesive tape 21 and the tape paper 11 between the rollers 19 and 17, and transports the tape paper 11 by the distance "f", whereby the adhesive of the adhesive tape 21 is transferred onto the area defined by "f" on the tape paper 11. Then, CPU 26 stops transporting the tape paper 11 (step S6) and brings the pressing/transferring roller 19 away from the transferring roller 17 (step S7).

Figure 8:
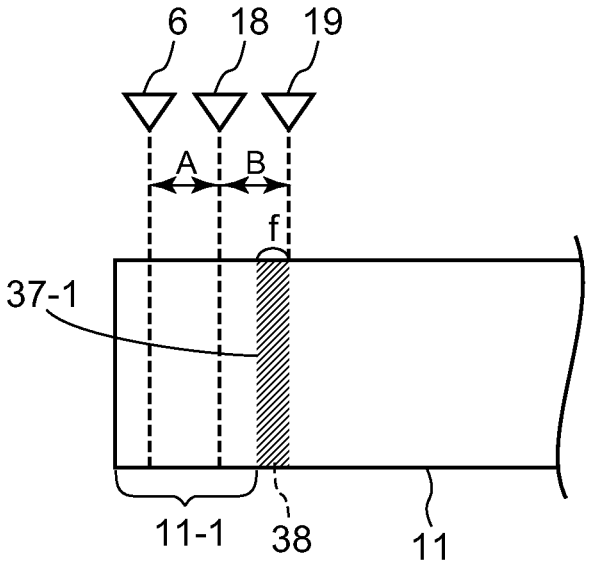
FIG. 8 is a view showing a relationship in position between the tape paper, a pressing/transferring roller, a thermal head, and a tape cutter in a label producing operation in the present printing apparatus.

FIG. 8 is a view showing a relationship in position between the tape paper 11, the pressing/transferring roller 19, the thermal head 18, and tape cutter 6 in the printing operation at steps S5 to S7. In FIG. 8, a distance between the tape cutter 6 and the thermal head 18 is denoted by "A" and a distance between the thermal head 18 and the pressing/transferring roller 19 is denoted by "B", which are also illustrated in FIG. 3. As illustrated in FIG. 8, the adhesive 38 is transferred onto the area defined by "f" on the tape paper 11, and the tape paper 11 is kept still with the pressing/transferring roller 19 brought away from the transferring roller 17.

The area defined by "f", where the adhesive 38 is to be transferred, is an area defined by "f" on the front end portion of the tape paper 11, where the adhesive 38 is to be transferred, in each of the labels 37*b* to 37*e* as illustrated in FIGS. 6B, 6C, 6D and 6E. As illustrated in FIG. 8, the pressing/transferring roller 19 takes a position at the rear end of the area defined by "f".

Therefore, when the overall area has been designated as the adhesive transferring form, the adhesive 38 is transferred onto the area defined by "f", without any change, using the pressing/transferring roller 19 kept down or taking the position at the rear end of the area defined by "f". Meanwhile, when either one of the left extreme area, the right extreme area, the top area, and the bottom area has been designated as the adhesive transferring form, the printing operation is performed with the pressing/transferring roller 19 kept away from the transferring roller 17.

In FIG. 8, since the tape paper 11 has been transported by a length corresponding to the adhesive transferring area "f", the front end of the tape paper 11 passes by the tape cutter 6 by the length of "f". A portion 11-1 from the front end of the tape paper 11 to the front edge of the adhesive transferring area "f" is an initial surplus portion (a distance, A+B), and therefore, this initial surplus portion is cut out when the front edge of the adhesive transferring area "f" comes to the position of the tape cutter 6.

Following the processes at steps S5 to S7 in FIG. 7, CPU 26 judges whether the overall area has been designated as the adhesive transferring form (step S8). When it is determined that the overall area has been designated as the adhesive transferring form (YES at step S8), CPU 26 brings the pressing/transferring roller 19 toward the transferring roller 17 (step S9) to prepare the adhesive transferring operation for transferring the adhesive onto the designated overall area of the tape paper 11.

Then, CPU 26 starts transporting the tape paper 11 to print the printing data on the tape paper 11, and temporarily stops printing and transporting the tape paper 11 when the tape paper 11 has been transported by a predetermined length (step S10).

More specifically, CPU 26 temporarily stops transporting the tape paper 11, when the rear end of the initial surplus portion 11-1 of the tape paper 11 illustrated in FIG. 8 has reached the position of the tape cutter 6, that is, when the front edge of the adhesive transferring area "f" at the time when the printing operation starts, has reached the position of the tape cutter 6, in other words, CPU 26 temporarily stops transporting the tape paper 11, when the front end 37-1 of the label 37*a* in FIG. 6A has reached the position of the tape cutter 6.

Further, CPU 26 operates the tape cutter 6 to cut the tape paper 11 at the its front end (step S11), whereby the initial surplus portion 11-1 of the tape paper 11 illustrated in FIG. 8 is cut out.

Then, CPU 26 resumes the printing operation to print the remaining print data (step S12), whereby the printing of the character string "ABCDE" has finished and the pressing/transferring roller 19 is brought away from the transferring roller 17 (step S13).

Finally, CPU 26 transports the tape paper 11 by a predetermined length (step S14), and stops transporting the tape paper 11 (step S15). CPU 26 stops transporting the tape paper 11 at the time when the rear end 37-2 of the label 37*a* with the character string "ABCDE" printed thereon has reach the position of the tape cutter 6.

Then, CPU 26 operates the tape cutter 6 to cut the label 37*a* at its rear end 37-2 (step S16), whereby the label 37*a* illustrated in FIG. 6A is separated from the tape paper 11 and discharged from the outlet chute 5.

Meanwhile, when it is determined that the overall area has not been designated as the adhesive transferring form (NO at step S8), CPU 26 judges whether the left extreme area (the label 37*b* in FIG. 6B) has been designated as the adhesive transferring form (step S17).

when it is determined that the left extreme area has been designated as the adhesive transferring form (YES at step S17), CPU 26 starts transporting the tape paper 11 to print the printing data on the tape paper 11, and temporarily stops printing and transporting the tape paper 11 when the tape paper 11 has been transported by a predetermined length (step S20).

In other words, CPU 26 temporarily stops transporting and printing the tape paper 11, when the rear end of the initial surplus portion 11-1 illustrated in FIG. 8 has reached the position of the tape cutter 6, that is, when the front edge 37-1 of the adhesive transferring area "f" of the label 37*b* in FIG. 6B has reached the position of the tape cutter 6.

Further, CPU 26 operates the tape cutter 6 to cut the tape paper 11 at the its front end (step S21), whereby the initial surplus portion 11-1 of the tape paper 11 illustrated in FIG. 8 is cut out.

Then, CPU 26 resumes printing the remaining print data on the tape paper 11 (step S22), thereby finishing the printing operation to produce the label 37*b* with the character string "ABCDE" printed thereon, having the adhesive transferring area "f" next to the character printing area.

Finally, CPU 26 performs the processes at steps S14, S15, and S16, whereby the rear end 37-2 of the label 37*b* with the character string "ABCDE" printed thereon (illustrated in FIG. 6B) is cut and separated from the tape paper 11 by the tape cutter 6, and the label 37*b* is discharged from the outlet chute 5.

Meanwhile, when it is determined that the left extreme area has not been designated as the adhesive transferring form (NO at step S17), CPU 26 judges whether the right extreme area (the label 37*c* in FIG. 6C) has been designated as the adhesive transferring form (step S18).

When it is determined that the right extreme area has been designated as the adhesive transferring form (YES at step S18), CPU 26 rotates the printing data expanded on RAM 28 180 degrees (step S19), whereby the character string "ABCDE" is reversed upside down and then the character string begins with "E" and proceeds to "A", as illustrated in FIG. 6C. This reversed character string is supplied to the printer controlling unit 34.

CPU 26 performs the processes at steps S20, S21, and S22. More specifically, CPU 26 starts the printing operation of the character string "EDCBA" (reversed upside down), and temporarily stops transporting and printing the tape paper 11 when a predetermined length of the tape paper 11 has been transported, whereby the initial surplus portion 11-1 of the tape paper 11 is cut out. Then, CPU 26 resumes the printing operation of a label 37*c* having the adhesive transferred area "f" with the reversed character "E" partially included.

Finally, CPU 26 performs the processes at steps S14, S15, and S16. More specifically, the rear end 37-2 of the label 37*c* with the character string "EDCBA" (reverse upside down) printed thereon (illustrated in FIG. 6C) is cut and separated from the tape paper 11 by the tape cutter 6, and the label 37*c* is discharged from the outlet chute 5.

Meanwhile, when it is determined that the right extreme area has not been designated as the adhesive transferring form (NO at step S18), CPU 26 determines that the top area (refer to FIG. 6D) or the bottom area (refer to FIG. 6E) is designated as the adhesive transferring form.

When the top area (FIG. 6D) or the bottom area (FIG. 6E) has been designated as the adhesive transferring form, CPU 26 performs a variable magnification process on the character string "ABCDE" (step S23). In the variable magnification process, CPU 26 changes the size of the character string of "ABCDE" such that the width of the printing data of "ABCDE" expanded on RAM 28 will meet the width of the tape paper 11.

Then, CPU 26 judges whether the top area (refer to the label 37*d* in FIG. 6D) has been designated as the adhesive transferring form (step S24).

When it is determined that the top area (refer to label 37*d* in FIG. 6D) has been designated as the adhesive transferring form (YES at step S24), CPU 26 rotates the printing data reduced in size and expanded on RAM 28 270 degrees in clockwise direction (step S25), whereby the character string of "ABCDE" is reduced in width so as to meet the width of the tape paper 11 and then supplied to the printer controlling unit 34 as an image as illustrated in FIG. 6D.

Further, CPU 26 performs the processes at steps S20, S21, and S22. More specifically, CPU 26 starts the printing operation of the character string of "ABCDE" reduced in size and arranged vertically (FIG. 6D), temporarily stops transporting the tape paper 11 and printing the character string thereon when a predetermined length of the tape paper 11 has been transported, and cuts out the initial surplus portion 11-1 of the tape paper 11. Then, CPU 26 resumes the printing operation of a label 37*d* having the adhesive transferred area "f" on the top side of the character string "ABCDE" arranged vertically (rotated 270 degrees) to the longitudinal direction of the tape paper 11.

Finally, CPU 26 performs the processes at steps S14, S15, and S16. More specifically, the character string "ABCDE" reduced in size and arranged vertically (rotated 270 degrees) has been printed on the label 37*d* as illustrated in FIG. 6D, and the rear end 37-2 of the label 37*d* is cut and separated from the tape paper 11 by the tape cutter 6, and the label 37*d* is discharged from the outlet chute 5.

Meanwhile, when it is determined that the top area has not been designated as the adhesive transferring form (NO at step S24), CPU 26 rotates the printing data reduced in size and expanded on RAM 28 90 degrees in clockwise direction (step S26), whereby the character string of "ABCDE" is arranged vertically and reduced in width so as to meet the width of the tape paper 11 and then supplied to the printer controlling unit 34 as an image as illustrated in FIG. 6E.

Further, CPU 26 performs the processes at steps S20, S21, and S22. More specifically, CPU 26 starts the printing operation of the character string of "ABCDE" reduced in size, and arranged vertically (rotated 90 degrees, FIG. 6E), temporarily stops transporting the tape paper 11 and printing the character string thereon, when a predetermined length of the tape paper 11 has been transported, and cuts out the initial surplus portion 11-1 of the tape paper 11. Then, CPU 26 resumes the printing operation of a label 37*e* having the adhesive transferred area "f" on the bottom side of the character string "ABCDE" arranged vertically (rotated 90 degrees) to the longitudinal direction of the tape paper 11.

Finally, CPU 26 performs the processes at steps S14, S15, and S16. More specifically, the character string "ABCDE" reduced in size and arranged vertically (rotated 90 degrees) has been printed on the label 37*e* as illustrated in FIG. 6E, and the rear end 37-2 of the label 37*e* is cut and separated from the tape paper 11 by the tape cutter 6, and the label 37*e* is discharged from the outlet chute 5.

As described above, the printing apparatus 1 with the adhesive applying function according to the embodiment of the invention is provided with the built-in adhesive transferring unit, and can supply various sorts of labels having the adhesive transferring form thereon, such as the overall area, left extreme area, right extreme area, top area, and bottom area, allowing the user to select the adhesive transferring form according to his/her need.

Although specific embodiments of the invention have been described in the foregoing detailed description, it will be understood that the invention is not limited to the particular embodiments described herein, but modifications and rearrangements may be made to the disclosed embodiments while remaining within the scope of the invention as defined by the following claims. It is intended to include all such modifications in the following claims and their equivalents.

What is claimed is:

1. A printing apparatus with an adhesive applying function, comprising:

an apparatus body which detachably receives a cartridge containing a transferring member having adhesive;

a transporting mechanism which transports an elongated print member, one surface of which data is to be printed on and the other surface of which no data is to be printed on;

a transferring mechanism which transports the transferring member having adhesive, contained in the cartridge, when the cartridge is installed on the apparatus body, and which selectively brings the transferring member into contact with the print member transported by the transporting mechanism while transporting the transferring member, thereby transferring the adhesive of the transferring member onto the surface of the print member, which surface no data is to be printed on;

a transfer controlling unit which controls whether or not the transferring mechanism transfers the adhesive of the transferring member onto the surface of the print member, which surface no data is to be printed on; and a printing mechanism which is provided in a transport direction of the print member transported by the transporting mechanism and on a downstream side of the transferring mechanism, and which prints data on the surface of the print member, which surface data is to be printed on.

2. The printing apparatus with an adhesive applying function, according to claim 1, wherein the printing mechanism enlarges or reduces in size print data and rotates the print data by a user's desired angles in unit of 90 degrees, and then prints the print data on the surface of the print member, which surface data is to be printed on.

3. The printing apparatus with an adhesive applying function, according to claim 1, further comprising:

a cutting unit for cutting the print member, which unit is provided in the transport direction of the print member and on the downstream side of the printing mechanism.

4. The printing apparatus with an adhesive applying function, according to claim 1, wherein the transporting mechanism comprises the printing mechanism and the transferring mechanism.

5. The printing apparatus with an adhesive applying function, according to claim 1, wherein the printing mechanism comprises a platen roller and a thermal head, and the platen roller serves as one of transport rollers of the transporting mechanism.

6. The printing apparatus with an adhesive applying function, according to claim 1, wherein the transferring mechanism comprises a pair of transferring rollers, which are brought into close to each other so as to sandwich the print member and the transferring member between said two rollers, thereby transporting the two members, wherein the pair of transferring rollers consists of a pressing/transferring roller of the apparatus body and a transferring roller of the cartridge.

7. The printing apparatus with an adhesive applying function, according to claim 6, wherein the transferring member is made of an elongated mat whose one surface is applied all over with adhesive, and is rolled round a feed roller and a take-up roller with a no adhesive-applied surface of the transferring member in contact with one of the pair of transferring rollers, and the one of the transferring rollers, the feed roller and the take-up roller are contained in the cartridge.

8. The printing apparatus with an adhesive applying function, according to claim 1, wherein plural cartridges are prepared, each containing a different transferring member having adhesive of a different adhesive force, respectively.

9. The printing apparatus with an adhesive applying function, according to claim 1, wherein the print member is a heat-sensitive tape.

10. A printing apparatus with an adhesive applying function, comprising:

an apparatus body which detachably receives a cartridge containing a transferring member having adhesive;

a transporting mechanism which transports an elongated print member, one surface of which data is to be printed on and the other surface of which no data is to be printed on;

a transferring mechanism which transports the transferring member having adhesive, contained in the cartridge, when the cartridge is installed on the apparatus body, and which selectively brings the transferring member into contact with the print member transported by the transporting mechanism while transporting the transferring member, thereby transferring the adhesive of the transferring member onto the surface of the print member, which surface no data is to be printed on;

a transfer controlling unit which controls whether or not the transferring mechanism transfers the adhesive of the transferring member onto the surface of the print member, which surface no data is to be printed on; and a printing mechanism which enlarges or reduces in size print data and rotates the print data by a user's desired angles in unit of 90 degrees, and then prints the print data on the surface of the print member, which surface data is to be printed on.

11. The printing apparatus with an adhesive applying function, according to claim 10, wherein the printing mechanism is provided in a transport direction of the print member transported by the transporting mechanism and on a downstream side of the transferring mechanism.

12. The printing apparatus with an adhesive applying function, according to claim 10, further comprising:

a cutting unit for cutting the print member, which unit is provided in a transport direction of the print member transported by the transporting mechanism and on a downstream side of the printing mechanism.

13. The printing apparatus with an adhesive applying function, according to claim 10, wherein the transporting mechanism comprises the printing mechanism and the transferring mechanism.

14. The printing apparatus with an adhesive applying function, according to claim 10, wherein the printing mechanism comprises a platen roller and a thermal head, and the platen roller serves as one of transport rollers of the transporting mechanism.

15. The printing apparatus with an adhesive applying function, according to claim 10, wherein the transferring mechanism comprises a pair of transferring rollers, which are brought into close to each other so as to sandwich the print member and the transferring member between said two rollers, thereby transporting the two members, wherein the pair of transferring rollers consists of a pressing/transferring roller of the apparatus body and a transferring roller of the cartridge.

16. The printing apparatus with an adhesive applying function, according to claim 15, wherein the transferring member is made of an elongated mat whose one surface is applied all over with adhesive, and is rolled round a feed roller and a take-up roller with a no adhesive-applied surface of the transferring member in contact with one of the pair of transferring rollers, and the one of the transferring rollers, the feed roller and the take-up roller are contained in the cartridge.

17. The printing apparatus with an adhesive applying function, according to claim 10, wherein plural cartridges are prepared, each containing a different transferring member having adhesive of a different adhesive force, respectively.

18. The printing apparatus with an adhesive applying function, according to claim 10, wherein the print member is a heat-sensitive tape.

* * * * *